United States Patent [19]

Schönmeier

[11] Patent Number: 4,487,545

[45] Date of Patent: Dec. 11, 1984

[54] METHOD AND APPARATUS FOR LOWERING WEB ROLLS IN WINDING MACHINES

[75] Inventor: Herbert Schönmeier, Düsseldorf, Fed. Rep. of Germany

[73] Assignee: Jagenberg AG, Düsseldorf, Fed. Rep. of Germany

[21] Appl. No.: 358,483

[22] Filed: Mar. 15, 1982

[30] Foreign Application Priority Data

Apr. 30, 1981 [DE] Fed. Rep. of Germany ..... 3117093

[51] Int. Cl.[3] ..... B65G 65/00

[52] U.S. Cl. ..... 414/684; 414/748; 414/911

[58] Field of Search ..... 414/680, 684, 910, 911, 414/748, 745, 787

[56] References Cited

U.S. PATENT DOCUMENTS

| | | | |
|---|---|---|---|
| 1,870,225 | 8/1932 | Berry | 414/911 X |
| 2,278,946 | 4/1942 | Richard et al. | 414/911 X |
| 3,118,546 | 1/1964 | McConnell et al. | 414/748 |
| 3,436,895 | 4/1969 | Pearne et al. | 414/748 X |

FOREIGN PATENT DOCUMENTS

| | | | |
|---|---|---|---|
| 2038279 | 7/1980 | United Kingdom | 414/911 |
| 639786 | 1/1979 | U.S.S.R. | 414/748 |

*Primary Examiner*—Robert J. Spar
*Assistant Examiner*—Terrance L. Siemens
*Attorney, Agent, or Firm*—Sprung Horn Kramer & Woods

[57] ABSTRACT

A method for lowering roll wound with a web on a winding machine wherein the roll is supported eccentrically on the upper portion of the circumference of a support roll, the roll being formed by winding the web onto a core tube carrying end insets, the method comprising lifting the web roll from below so as to disengage it from the support roll, withdrawing the end insets from the core tube, and then lowering the web roll to a removal level out of contact with the support roll. A suitable apparatus is provided comprising a trough 4 for holding the wound wed roll, and drive means 9 for raising and lowering the trough along an arcuate path corresponding to the circumference of the support roll 1. The trough comprises a pair of plates 5 and 6 pivotally connected to one another about a horizontal shaft, plate 5 picking up the web roll 2 by its underside and being laterally guided by a cam follower 13 guided along a cam 14.

6 Claims, 3 Drawing Figures

METHOD AND APPARATUS FOR LOWERING WEB ROLLS IN WINDING MACHINES

BACKGROUND OF THE INVENTION

The invention relates to a method and an apparatus for lowering web rolls in winding machines from the winding position, located on the upper portion of the circumference of a support roll with the axes of the web roll and support roll lying in different parallel vertical planes, onto a lower take-off level.

In shaftless winding on machines with two support rolls, the finished web roll is pushed off the support rolls and onto a take-off table by means of an ejector or pusher bar. In this operation, the web roll remains in approximately the same plane.

Now when the web roll is to be lowered from the winding position to a lower level at the end of the winding operation, it is known from British Pat. No. 1,195,274, for example, to employ in winding with a core shaft supported in bearings a pair of pivotable lever arms which grip the shaft of the web roll and lower it from the cradle in which it is held in the winding position onto a lower take-off level.

SUMMARY OF THE INVENTION

The object of the invention is to provide ways and means for the simple and effective transfer of web rolls of different diameters from their winding position, offset both vertically and horizontally on the upper portion of the circumference of a support roll, onto a lower take-off level.

The pivot-lever arrangement known from British Pat. No. 1,195,274 is not suited for the purposes of the present invention since the British patent's arrangement is based on the premise that transferring the web roll by gripping it in proximity to its axis, which here is not feasible because of the great weight of the roll and the use of cardboard tubes.

In accordance with the invention, said object is accomplished by a method of lowering web rolls in winding machines from the winding position, located eccentrically on the upper portion of the circumference of a support roll, to a lower take-off level wherein the web roll is picked up by its underside and lifted off the support roll, the guide insets are withdrawn from the ends of the core tube while the web roll is in a raised position, and the web roll is lowered onto the take-off level.

In the winding position, located eccentrically on the upper portion of the circumference of a support roll, the web roll is held and guided by end insets set axially into the core tube. Part of the weight of the web roll is borne by the support roll, and part of the weight is carried by means of the core-tube end insets. Guidance of the web roll is necessary because as its diameter increases its axis moves radially away from the support roll. With this winding technique, two web rolls or, in the case of a slit web being wound onto different web rolls, two groups of web rolls are usually wound simultaneously on one support roll.

An essential characteristic of the method in accordance with the invention is that the web roll is lifted off the support roll by being picked up by its underside. As it is lifted off the support roll and carried to a lower level, the web roll is thus supported from underneath, with its entire weight resting on the supporting means.

The web roll is preferably lowered along an arcuate path which may conform to the curvature of the support roll. This permits space-saving lowering of the web roll and the use of a lowering apparatus of relatively simple design.

The lowering apparatus in accordance with the invention consists of a lowering trough adapted to be raised and lowered over an arcuate path by drives. To relieve the load on the raising and lowering drive, the lowering trough may be laterally guided along cam members. When the lowering trough is laterally guided and supported, part of the weight of the web roll is carried by the guiding means as the web roll is lifted off the support roll.

As the web roll is being lowered, the lowering trough may be supported on the cam members through laterally disposed sliding- or rolling-contact bearings. In this way, the friction between the lowering trough and the lateral guiding and supporting means during the lowering of the web roll is reduced.

In a preferred embodiment of the apparatus of the invention, the lowering trough is formed by two plates which are pivotably linked to each other along a horizontal axis, the plate picking up the web roll by its underside being laterally guided along the cam members at least in the upper region of its path. In the lowering trough formed by the pivotably linked plates when they are set at an angle to each other, web rolls of different diameters can be securely held and carried away from the support roll to a lower take-off level.

To permit the plates forming the lowering trough to be set at an angle relative to each other and that angle to be varied, the plates are preferably pivotable relative to each other through drives articulated to them. Before engaging the underside of the web roll for the purpose of lifting it off the support roll and lowering it to the lower take-off level, the plates forming the lowering trough are pivoted into a given angular position relative to each other by means of these auxiliary drives. Once the web roll has been lowered onto the take-off level, the plates can be aligned to be flush with each other, forming one plane.

To accomplish the lifting of the web rolls from the support roll and their placement into the lowering trough, the plate which picks up the web rolls by their underside is, in a further advantageous embodiment of the invention, inclined downwardly from the support roll by an angle ranging from 1 to 3 degrees, regardless of the diameter of the web rolls (see FIG. 3), as the latter are being lifted. The other plate is inclined more sharply, for example, at an angle of 45 degrees to the horizontal, with the two plates then making an angle of about 135 degrees with each other. The plates may be maintained in this angular position until the lowering operation is completed. The web rolls are thus prevented from accidentally rolling out of the lowering trough.

The distribution of forces will be best when the raising and lowering drive for the lowering through acts upon the plate which is inclined 45 degrees to the horizontal while the other plate, inclined from 1 to 3 degrees to the horizontal, which at the start of the lifting and lowering of the web roll carries most of its weight, bears laterally on the guiding cam members, which then largely support the web roll. Toward the end of the lowering operation, most of the weight of the web roll shifts to the lowering-trough plate which is supported by the raising and lowering drives.

As pointed out, the lateral guiding cam members serve to support the lowering trough as the web roll is being lowered. However, they also serve to guide the lowering trough both as it is being raised to pick up the web roll and lift it off the support roll and as the web roll is being lowered.

The lowering apparatus of the invention solves the problem of carrying web rolls of different diameters from the winding position on the support roll by simple means onto a lower take-off level. Its specific construction is determined by appropriate design work.

BRIEF DESCRIPTION OF THE DRAWINGS

The invention will now be described in greater detail with reference to the accompanying drawings, wherein.

DETAILED DESCRIPTION OF THE INVENTION

Figure 1:
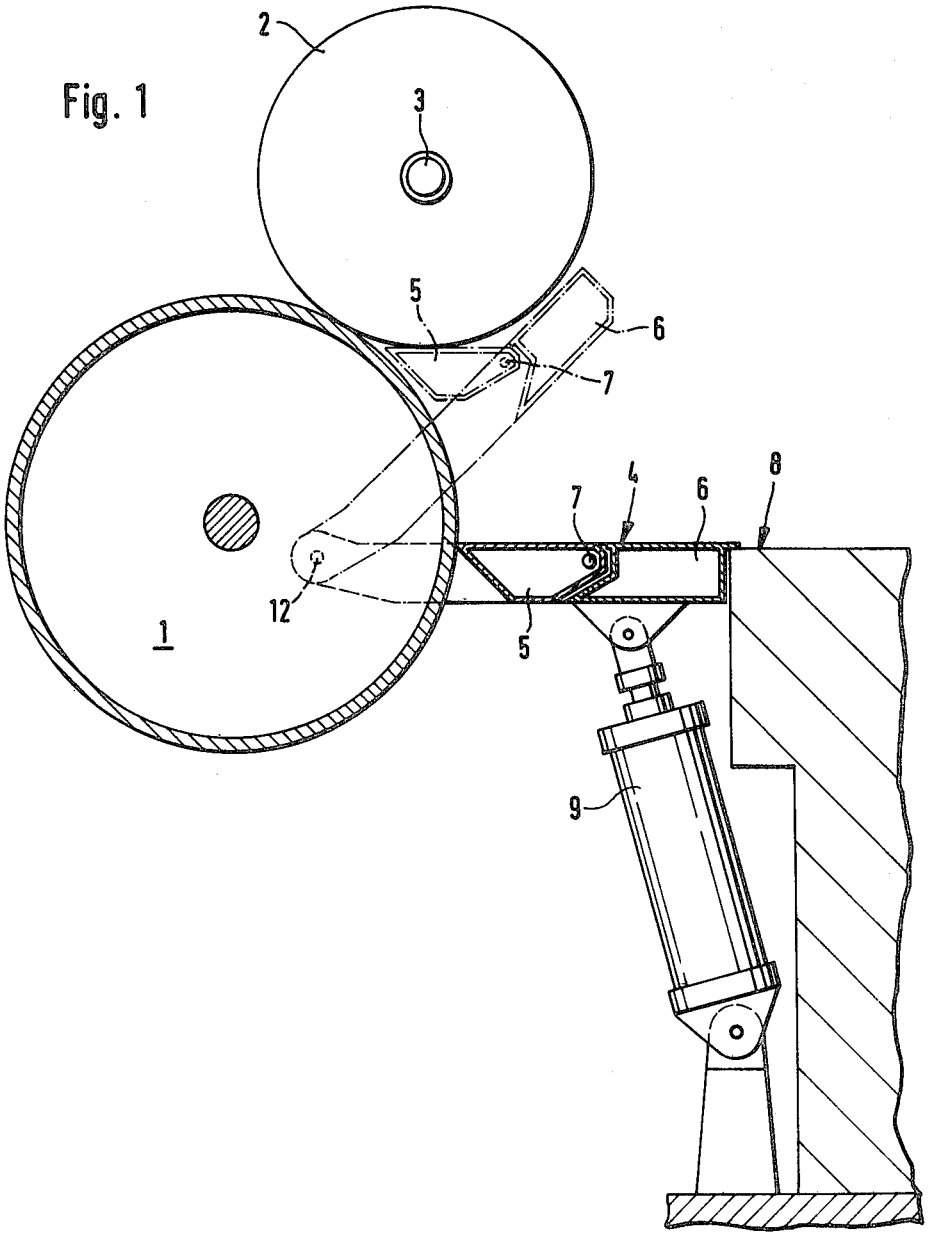
FIG. 1 is a side-elevational view of the apparatus.

FIG. 1 shows half of a support roll 1 on the upper portion of whose circumference a web roll 2, into which core-tube tube end insets 3 are axially set, rides eccentrically.

The lowering trough 4 consists of two plates 5 and 6 in the form of boxes which are pivotably linked to each other along the horizontal axis 7. In FIG. 1, the lower extreme position of the lowering trough 4, in which the latter is in the same plane as the take-off level 8, is shown in solid lines while its upper position, in which the trough is about to lift the web roll 2 off the support roll 1, is indicated by dash-dotted lines. In the latter position, the plates 5 and 6 make an angle of about 135 degrees with each other. Plate 5 of the lowering trough 4, which supports the web roll 2, is at an angle of about 2 degrees to the horizontal so that after the web roll 2 has been lifted off it rolls rightward (in the drawing) into the lowering trough 4 and is securely held therein.

Raising and lowering of the lowering trough 4 is effected through the pneumatic or hydraulic drive 9 located below the take-off level 8. It is articulated to plate 6 of the lowering trough 4.

Figure 3:
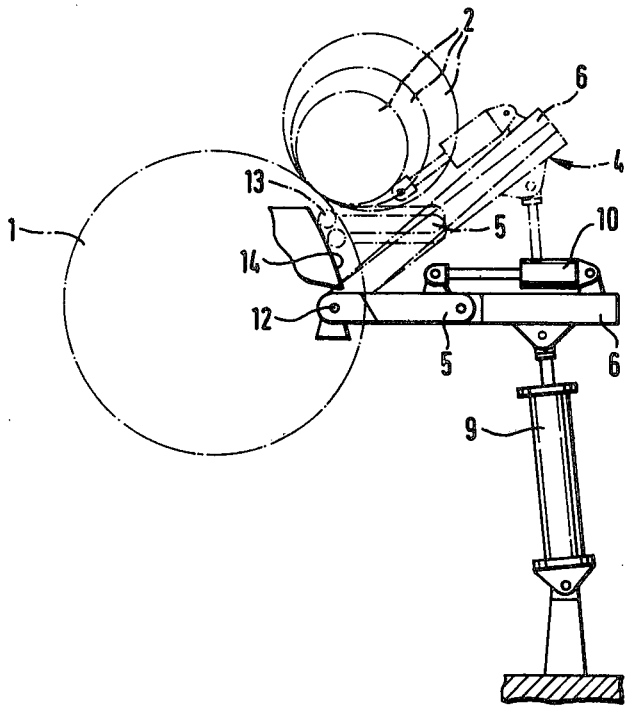
FIG. 3 is a side-elevational view, with the frame omitted, showing how the lowering trough is supported.

The pivoting motion of the plates 5 and 6 relative to each other is actuated by an auxiliary drive 10, which acts upon both plates 5 and 6 of the lowering trough 4, as shown in FIG. 3.

Figure 2:
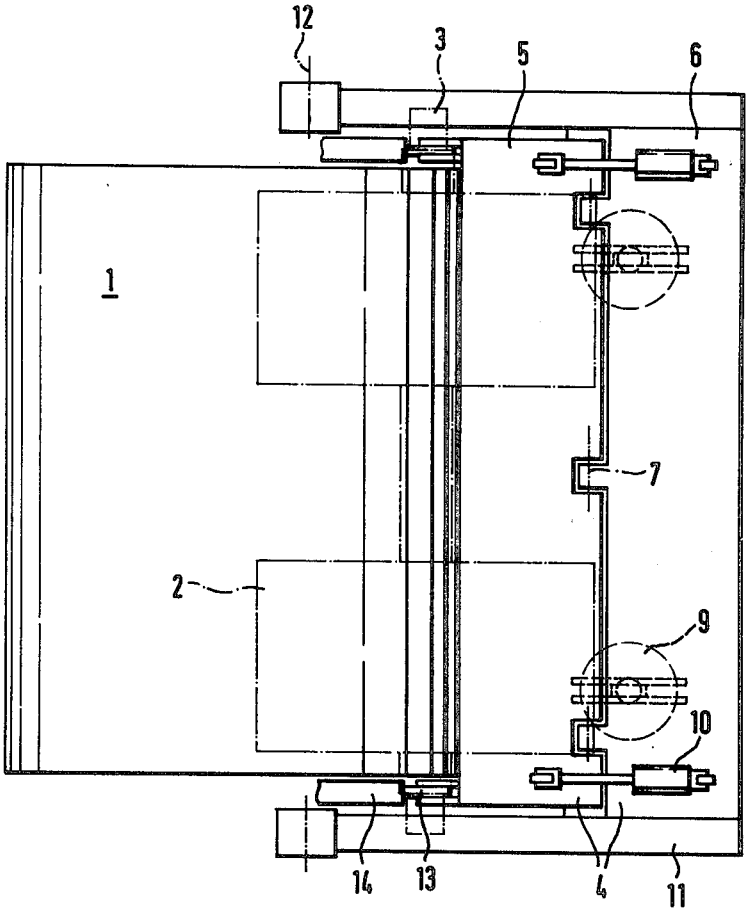
FIG. 2 is a top plan view thereof.

As is apparent from FIG. 2, plate 6 of the lowering trough 4, to which lever arms 11 are secured, pivots on a shaft 12 as the raising and lowering drives 9 are actuated and in so pivoting follows an arcuate path. Before the lowering trough 4 is raised from its lower extreme position, plate 5 of the lowering trough 4 can be pivoted by means of the auxiliary drive 10 into a predetermined angular position relative to plate 6 which corresponds to the upper position shown in FIG. 1.

As may be seen from FIG. 3, plate 5 of the lowering trough 4 is laterally, beyond the ends of the support roll 1, supported through rolling-element bearings 13 on a supporting and guiding cam member 14. The latter may be straight or curved, depending on design and local requirements.

It will be appreciated that the instant specification and claims are set forth by way of illustration and not of limitation, and that various changes and modifications may be made without departing from the spirit and scope of the present invention.

What is claimed is:

1. A method for lowering a roll wound with a web on a winding machine wherein the roll is supported on the upper portion of the circumference of a support roll with the axes of the roll and support roll lying in different parallel vertical planes, the roll being formed by winding the web onto a core tube carrying end insets, the method comprising lifting the web roll from below so as to relieve the weight of the wound web roll from the end insets, withdrawing the end insets from the core tube, and then lowering the web roll to a removal level while out of contact with the support roll.

2. A method according to claim 1, wherein the web roll is lowered along an arcuate path.

3. A method according to claim 2, wherein the web roll is lowered along an arcuate path spaced from the circumference of the support roll.

4. An apparatus for lowering a roll wound with a web on a winding machine wherein the roll is supported on the upper portion of the circumference of a support roll with the axes of the roll and support roll lying in different parallel vertical planes, comprising a trough for holding the wound web roll, drive means for raising and lowering the trough along an accurate path spaced from the circumference of the support roll, and cam and follower members for laterally guiding the trough in raising and lowering, the trough comprising two plates linked together for pivoting motion about a horizontal shaft, one of the plates picking up the web roll by its underside from the support roll and being laterally guided along said cam by said followers at least in the upper region of its path.

5. An apparatus according to claim 4, wherein the plates are pivotable relative to each other by means of a drive articulated to them.

6. An apparatus according to claim 4, wherein the plate which picks up the web roll by its underside to lift it is inclined downwardly away from the support roll at an angle of between 1 and 3 degrees.

* * * * *